US010251444B2

(12) United States Patent
Corbett

(10) Patent No.: US 10,251,444 B2
(45) Date of Patent: Apr. 9, 2019

(54) SLIDING-SHOE SOLE

(75) Inventor: Robert Corbett, Los Angeles, CA (US)

(73) Assignee: GROOVE, LLC, Los Angeles, CA (US)

( * ) Notice: Subject to any disclaimer, the term of this patent is extended or adjusted under 35 U.S.C. 154(b) by 25 days.

(21) Appl. No.: 14/007,317

(22) PCT Filed: Mar. 23, 2012

(86) PCT No.: PCT/US2012/030466

§ 371 (c)(1),
(2), (4) Date: Dec. 20, 2013

(87) PCT Pub. No.: WO2012/135071

PCT Pub. Date: Oct. 4, 2012

(65) Prior Publication Data

US 2014/0290099 A1 Oct. 2, 2014

Related U.S. Application Data

(60) Provisional application No. 61/467,830, filed on Mar. 25, 2011.

(51) Int. Cl.
*A43B 5/12* (2006.01)
*A43B 5/18* (2006.01)
(Continued)

(52) U.S. Cl.
CPC ..... *A43B 13/18* (2013.01); *A43B 3/16* (2013.01); *A43B 3/246* (2013.01); *A43B 5/005* (2013.01);
(Continued)

(58) Field of Classification Search
CPC .. A43B 5/12; A43B 5/18; A43B 5/005; A43B 5/008; A43B 13/18; A43B 13/181; A43B 3/16; A43B 3/246
(Continued)

(56) References Cited

U.S. PATENT DOCUMENTS 1,537,761 A 5/1925 Geisman
1,984,989 A 12/1934 Reed
(Continued)

FOREIGN PATENT DOCUMENTS

DE 1943298 A1 3/1971

OTHER PUBLICATIONS

The Engineering ToolBox, Friction and Coefficients of Friction, http://www.engineeringtoolbox.com/friction-coefficients-d_778.html. *

(Continued)

*Primary Examiner* — Alissa J Tompkins
*Assistant Examiner* — Cameron A Carter
(74) *Attorney, Agent, or Firm* — Wilson Sonsini Goodrich & Rosati

(57) ABSTRACT

The sliding-shoe sole is a device that is permanently attached or removably positioned on fitness shoes. The sliding-shoe sole is fabricated from materials that reduce the degree of frictional contact between the sole and a contacting surface. The sliding-shoe sole may encompass a portion or the entire bottom of the fitness shoe and portions of the heel, toe and side areas of the shoe. This arrangement enables the wearer to participate more fully in exercises and/or dances that require the foot to not only slide and/or glide along the dance floor or exercise surface along the shoe bottom, but also along the shoe heel, toe and side.

8 Claims, 20 Drawing Sheets

(51) Int. Cl.

| | |
|---|---|
| ***A43B 5/00*** | (2006.01) |
| ***A43B 3/16*** | (2006.01) |
| ***A43B 3/24*** | (2006.01) |
| ***A43B 13/18*** | (2006.01) |

(52) U.S. Cl.
CPC ..... *A43B 5/008* (2013.01); *A43B 5/12* (2013.01); *A43B 5/18* (2013.01); *A43B 13/181* (2013.01)

(58) Field of Classification Search
USPC ..... 36/103, 102, 3 B, 7.1 R, 8.3, 25 R, 130
See application file for complete search history.

(56) References Cited

U.S. PATENT DOCUMENTS

| | | | | | |
|---|---|---|---|---|---|
| 2,168,303 | A | | 8/1939 | Sothen | |
| 2,572,671 | A | * | 10/1951 | Shaw | A43B 5/12 280/11.12 |
| 2,733,522 | A | * | 2/1956 | Murray | A43B 1/0009 12/142 A |
| 3,703,775 | A | * | 11/1972 | Gatti | A43B 5/025 36/128 |
| 4,134,220 | A | * | 1/1979 | Dassler | A43B 5/10 36/114 |
| 4,282,657 | A | * | 8/1981 | Antonious | A43B 5/00 24/306 |
| 4,716,664 | A | * | 1/1988 | Taylor | A43B 21/18 36/114 |
| 5,313,718 | A | * | 5/1994 | McMahon | A43B 13/26 36/114 |
| 5,615,495 | A | * | 4/1997 | Mastrocola | A43B 3/163 36/2.6 |
| 5,682,685 | A | * | 11/1997 | Terlizzi | A43B 5/12 36/102 |
| 5,692,322 | A | * | 12/1997 | Lombardino | A43B 3/24 36/100 |
| 5,832,636 | A | | 11/1998 | Lyden et al. | |
| 5,881,478 | A | * | 3/1999 | McMahon | A43B 13/181 36/127 |
| 5,956,868 | A | * | 9/1999 | Stevens | A43B 3/26 36/8.3 |
| 6,052,921 | A | * | 4/2000 | Oreck | A43C 1/00 36/50.1 |
| 6,243,973 | B1 | * | 6/2001 | Lind | A43B 13/26 36/100 |
| 6,311,415 | B1 | * | 11/2001 | Lind | A43B 5/00 36/130 |
| 6,651,360 | B1 | * | 11/2003 | Lind | A43B 13/26 36/130 |
| D500,913 | S | | 1/2005 | Mangee | |
| D500,914 | S | | 1/2005 | Ammon | |
| 6,836,977 | B2 | * | 1/2005 | Larson | A43B 3/16 36/59 R |
| 7,266,912 | B2 | | 9/2007 | Whatley | |
| 7,337,558 | B2 | | 3/2008 | Terlizzi et al. | |
| 7,591,084 | B2 | * | 9/2009 | Santa Ana | A43B 1/0054 36/100 |
| 7,685,739 | B2 | * | 3/2010 | Aveni | A43B 3/24 36/100 |
| 8,074,376 | B1 | * | 12/2011 | Teteriatnikov | A43B 3/0042 36/115 |
| 8,701,310 | B1 | * | 4/2014 | Walsh | A43B 3/16 36/7.2 |
| 2002/0144437 | A1 | * | 10/2002 | Davis | A43B 5/00 36/115 |
| 2004/0148797 | A1 | | 8/2004 | Nelson et al. | |
| 2006/0086002 | A1 | * | 4/2006 | Vickers | A43B 3/16 36/7.1 R |
| 2007/0000152 | A1 | * | 1/2007 | Nakayama | A43B 21/42 36/42 |
| 2007/0107264 | A1 | * | 5/2007 | Meschter | A43B 5/12 36/76 R |
| 2008/0010854 | A1 | * | 1/2008 | Sokolowski | A43B 5/12 36/8.3 |
| 2008/0034613 | A1 | * | 2/2008 | Wilkenfeld | A43B 3/06 36/8.3 |
| 2009/0049711 | A1 | * | 2/2009 | Finch | A43B 5/18 36/7.6 |
| 2009/0235556 | A1 | * | 9/2009 | Reid | A43B 3/163 36/7.1 R |
| 2010/0122473 | A1 | * | 5/2010 | Santos | A43B 13/36 36/100 |
| 2010/0223818 | A1 | * | 9/2010 | Hampton | A43B 3/0078 36/3 B |
| 2010/0293815 | A1 | * | 11/2010 | Ferrigan | A43B 3/0042 36/25 R |

OTHER PUBLICATIONS

AMF. AMF Shoe Slide Sock. http://www.amazon.com/AMF-Shoe-Slide-Sock/dp/B000VR0M2S/ref=sr_1_5?ie=UTF8&qid=1330055210&sr=8-5. Accessed on Jan. 8, 2016. 3 pages.

Aris Allen. Aris Allen Women's Black Retro Runner Dance Sneakers. http://www.amazon.com/Aris-Allen-Womens-Runner-Sneakers/dp/B009K6PTOC. Accessed on Jan. 8, 2016. 4 pages.

Aris Allen. The Aris Allen Raw Sole. http://www.arisallen.com/rawsole.html. Accessed on Jan. 8, 2016. 1 page.

Brunswick. Brunswick Clear Top Shoe Slider. http://www.amazon.com/Brunswick-Clear-Top-Shoe-Slider/dp/B001FBNM9E/ref=sr_1_23?ie=UTF8&qid=1330055665&sr=8-23. Accessed on Jan. 8, 2016. 3 pages.

Brunswick. Brunswick Offense Shoe Slider. http://www.amazon.com/Brunswick-Offense-Shoe-Slider/dp/B000WFL8WW/ref=sr_1_15?ie=UTF8&qid=1330055786&sr=8-15. Accessed on Jan. 8, 2016. 6 pages.

Cuddledown. Leather Ballet Wedge Slipper. http://www.cuddledown.com/product/leather-ballet-wedge-slipper.do?code=ISEG012&extcmp=cse_goog_gen_pd&utm_source=froogle&utm_medium=cse&utm_campaign=2012. Accessed Mar. 1, 2012. 2 pages.

Dancestore.com. Aris Allen Men's Black Classic Dress Dance Sneaker. http://dancestore.com/products/8310-bk-aris-allen-mens-black-classic-dress-sneaker-dance-shoe?variant=1977446212. Accessed on Jan. 8, 2016. 2 pages.

Dancestore.com. Aris Allen Women's Blue Retro Running Dance Sneakers. http://www.dancestore.com/Aris-Allen-Womens-Blue-Retro-Running-Dance-Sneakers/productinfo/176-BL/. Accessed on Mar. 1, 2012. 2 pages.

DeFY New York YouTube Channel. Nike Night Track Disco Sneaker 1982 (Studio 54) Sneaker Review. https://www.youtube.com/watch?v=hOYHnfb49EA. Uploaded on Nov. 27, 2010. Accessed on Jan. 8, 2016. 2 pages.

Dexter. Dexter S8 Replacement Sole. http://www.amazon.com/Dexter-Slide-Sole-S8-Replacement/dp/B003C3935A/ref=sr_1_33?ie=UTF8&qid=1330055717&sr=8-33. Accessed on Jan. 8, 2016. 4 pages.

Double Select. Nike Vintage Night Track 78 aka Studio 54's. http://www.doubleselect.com/2007/10/02/nike-vintage-night-trek-78-aka-studio-54s/. Accessed on Jan. 8, 2016. 8 pages.

International search report and written opinion dated Sep. 28, 2012 for PCT/US2012/030466.

Li, et al. Floor slipperiness measurement: friction coefficient, roughness of floors, and subjective perception under spillage conditions. Safety Science, 2004, 42(6), 547-565.

New Aerobic Lateral Training Board Slide Booties 4 Pair. http://compare.ebay.com/like/380169414467?ltyp=AllFixedPriceItemTypes&var=sbar. Accessed on Feb. 8, 2012. 3 pages.

Pro Slideboard. Pro Slide Booties. http://www.amazon.com/Pro-Slideboard-Slide-Booties-X-LARGE/dp/B001DEPAK2. Accessed on Jan. 8, 2016. 3 pages.

Sheepskin. Sheepskin Soft Sole Slippers. http://sheepskinproductsoutlet.com/sheepskin-soft-sole-slippers.html. 2016. 1 page.

Simtec. Simtec Fun Slides Carpet Skates. http://www.amazon.com/Simtec-Fun-Slides-Carpet-Skates/dp/B000MN8DT0/ref=sr_1_3?ie=UTF8&qid=1330055170&sr=8-3. Accessed on Mar. 1, 2012. 6 pages.

(56) References Cited

OTHER PUBLICATIONS

Warkov-Safeer. Leather Half Sole. http://warkov.com/leather/leatherImages/BAJ%20Leather%20Half%20Sole.gif. Accessed on Jan. 8, 2016. 1 page.
Zumba. Zumba Carpet Gliders. http://www.zumba.com/shop/product/zumba-carpet-gliders. Accessed on Mar. 1, 2012. 3 pages.

* cited by examiner

SLIDING-SHOE SOLE

CROSS-REFERENCE

This application claims the benefit of U.S. Provisional Application No. 61/467,830, filed Mar. 25, 2011, which application is incorporated herein by reference.

BACKGROUND OF THE INVENTION

Recreational dancing has always been a popular, participatory endeavor for children, teenagers and adults. Dancing is the subject of some of the most popular television shows. Dancing and dance exercise are also encouraged as methods to fight obesity and other health problems that may be incurred by lack of exercise. Unfortunately, many people lack or feel that they lack the inherent mobility and dexterity required to be reasonably proficient on the dance or exercise floor. This lack induces a reluctance to participate to avoid perceived embarrassment. A sole that would reduce the degree of frictional contact between the shoe and the dance or exercise surface would greatly enhance one's dexterity and mobility and encourage more participation in dancing and exercise. There are some devices disclosed in the related art that may be attached to the sole of a shoe to reduce friction. These devices, however, are primarily directed to the conventional dance shoe, and usually involve sliding discs or lifts positioned on the sole adjacent the heel area of the shoe. Today, except for formal affairs, most people who participate in dance or dance exercise wear fitness shoes that have no defined area between the sole and the heel. Thus, lifts or sliding discs could not be properly positioned thereon. The art would readily accept a sole that could be applied to a fitness shoe that would not only reduce frictional contact on the bottom of the shoe, but also on the side and toe of the shoe. Thus, a sliding-shoe sole solving the aforementioned problems is desired.

SUMMARY OF THE INVENTION

The sliding-shoe sole is a device that may be permanently attached or removably positioned on fitness shoes or the like. The sliding-shoe sole can be fabricated from materials that reduce the degree of frictional contact between the sole and a contacting surface. The sliding-shoe sole may encompass the entire bottom of the fitness shoe and portions of the heel, toe and side areas of the shoe. This arrangement may enable the wearer to participate more fully in exercises and/or dances that require the foot to not only slide and/or glide along the dance floor or exercise surface along the shoe bottom, but also along the shoe heel, toe and sides.

Accordingly, the invention presents a sole applicable to fitness shoes or the like that may greatly enhance the mobility and dexterity of the user when performing dance and/or exercise techniques that require fluid sliding or gliding motions. The sole may be permanently attached or removably positioned on the fitness shoes. The invention provides for improved elements thereof in an arrangement for the purposes described that may be inexpensive, dependable and fully effective in accomplishing their intended purposes.

These and other features of the present invention will become readily apparent upon further review of the following specification and drawings. Other goals and advantages of the invention will be further appreciated and understood when considered in conjunction with the following description and accompanying drawings. While the following description may contain specific details describing particular embodiments of the invention, this should not be construed as limitations to the scope of the invention but rather as an exemplification of preferable embodiments. For each aspect of the invention, many variations are possible as suggested herein that are known to those of ordinary skill in the art. A variety of changes and modifications can be made within the scope of the invention without departing from the spirit thereof.

INCORPORATION BY REFERENCE

All publications, patents, and patent applications mentioned in this specification are herein incorporated by reference to the same extent as if each individual publication, patent, or patent application was specifically and individually indicated to be incorporated by reference.

BRIEF DESCRIPTION OF THE DRAWINGS

The novel features of the invention are set forth with particularity in the appended claims. A better understanding of the features and advantages of the present invention will be obtained by reference to the following detailed description that sets forth illustrative embodiments, in which the principles of the invention are utilized, and the accompanying drawings of which:

Similar reference characters denote corresponding features consistently throughout the attached drawings.

DETAILED DESCRIPTION OF THE INVENTION

The invention provides systems and methods providing footwear with a low coefficient of friction. Various aspects of the invention described herein may be applied to any of the particular applications set forth below or for any other fitness shoes. The invention may be applied as a standalone system or method, or as part of an integrated fitness regime or footwear variations. It shall be understood that different aspects of the invention can be appreciated individually, collectively, or in combination with each other.

Figure 1:
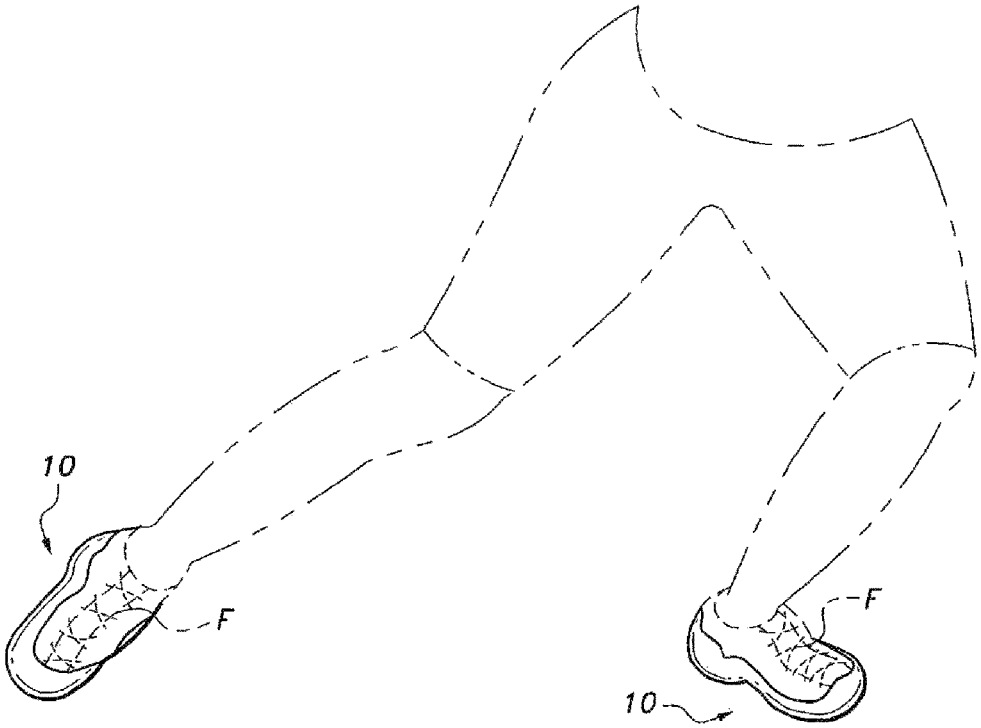
FIG. 1 is an environmental, perspective view of a sliding-shoe sole according to the present invention.
Figure 2:
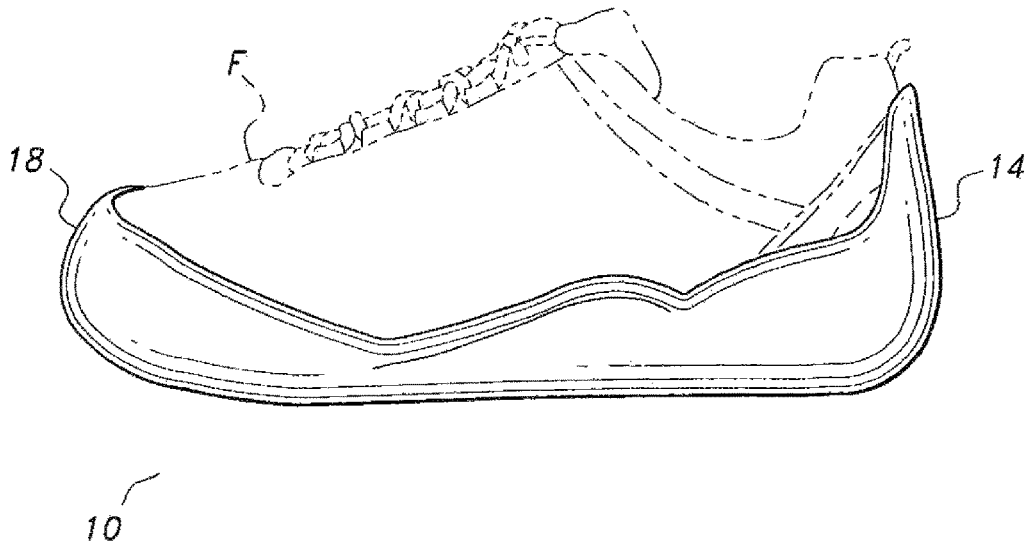
FIG. 2 is a side view of a first embodiment of a sliding-shoe sole according to the present invention.
Figure 3:
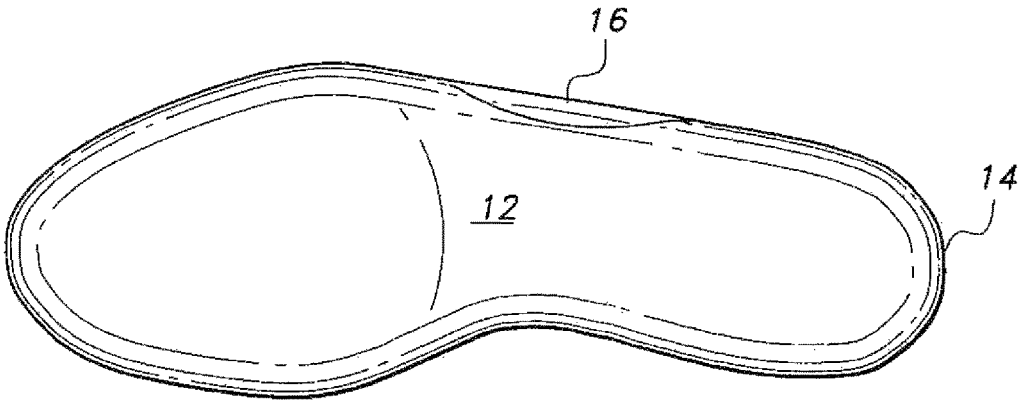
FIG. 3 is a bottom view of a sliding-shoe sole according to the present invention.

Attention is first directed to FIGS. 1-3 wherein an embodiment of the sliding-shoe of the present invention is generally indicated at 10. The sole may be permanently attached to the shoe F. As discussed above, the sole 10 is fabricated from a material or a combination of materials that greatly reduce friction between the sole and a contacting surface, such as a dance floor or carpet, i.e., the material(s) has a low coefficient of friction. The sole 10 may comprise a smooth bottom portion 12 that has a length and width substantially coextensive with the length and width of the shoe F. The sole 10 may have a rear portion 14, side portions 16, and a front portion 18. The several portions 14, 16, 18 may encompass respective heel, side, and toe areas of the shoe F. As discussed above, this arrangement may permit the wearer to employ movements of the feet with enhanced maneuverability that may require not only bottom, but also heel, toe, and side sliding contact with a floor, carpet or other dance or exercise surface.

Figure 4:
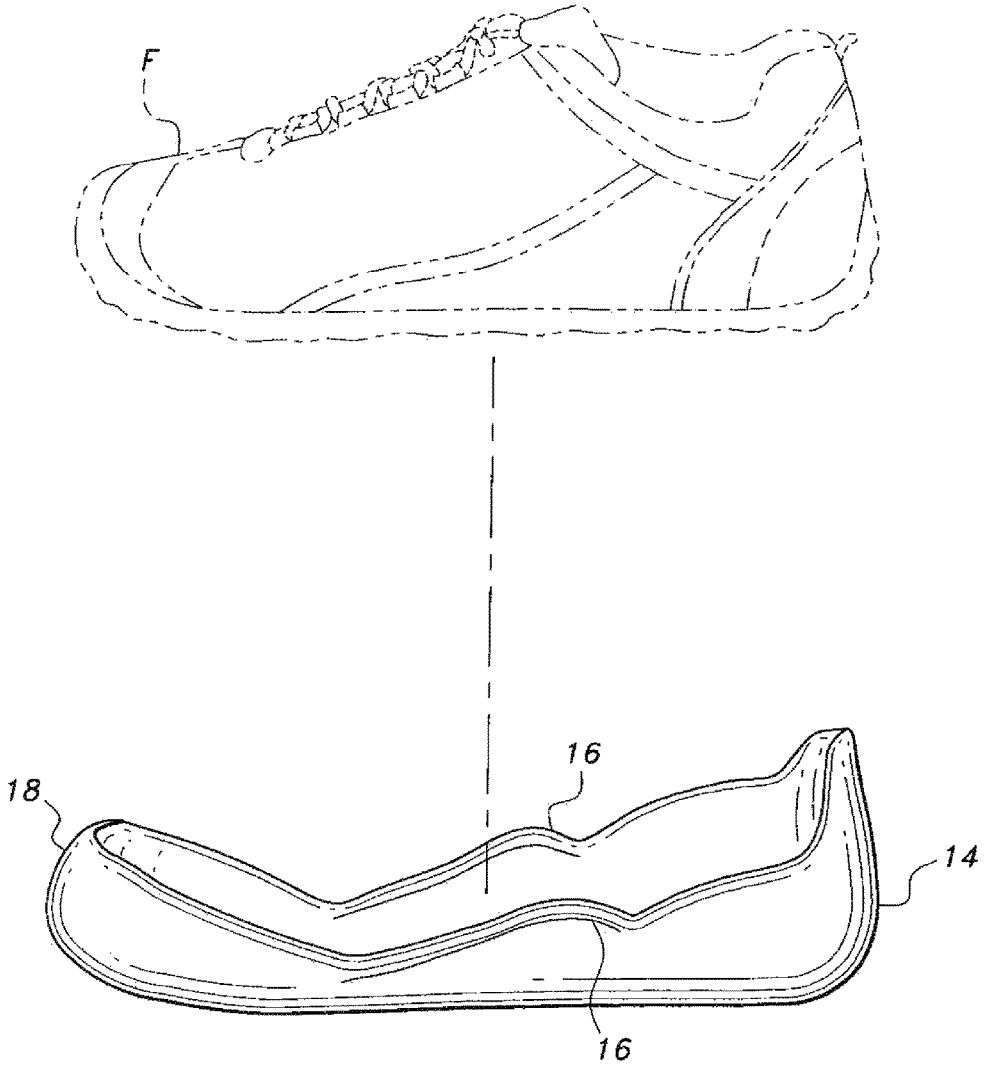
FIG. 4 is a perspective, exploded view of a second embodiment of a sliding-shoe sole according to the present invention.

Another embodiment of the invention is best seen in FIG. 4. The instant embodiment incorporates a removable sole fabricated in one piece. The sole may be slightly elastic or resilient to allow the sole fit snugly on the shoe F. The sole may be adapted to cover the outsole, the welt (or imitation welt), the heel, the toecap, a substantial portion of the counter, and the lower portion of the upper, at least enough to elastically grip the sole of the fitness or athletic shoe F, and to provide the sole with a low coefficient of friction when the lateral edges of the sole or side of the foot bear against the floor. The removable sole may be made available in different sizes and colors to accommodate the needs and aesthetic desires of potential users.

Figure 5:
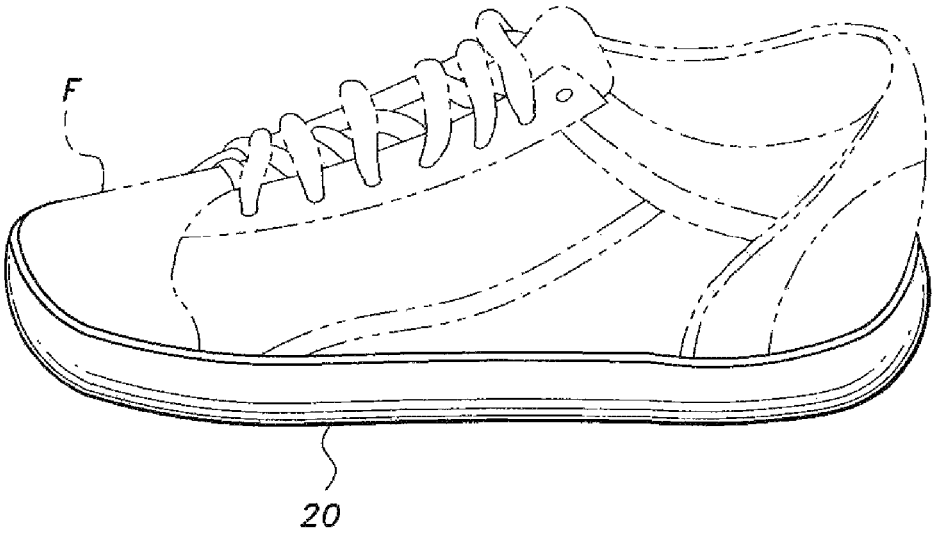
FIG. 5 is a perspective view of a third embodiment of a sliding-shoe sole according to the present invention.

Additional embodiments of the invention are illustrated in FIG. 5. This embodiment may be emulative of the characteristics of one of the most popular fitness shoe styles in the world. The embodiment of FIG. 5 incorporates a sole 20 that may be of a substantially uniform width (approximately one inch), which sole encapsulates the heel sides and toe areas of the shoe F. As in the previous embodiments, the sole may be fabricated from a smooth material having a low coefficient of friction.

Figure 7A:
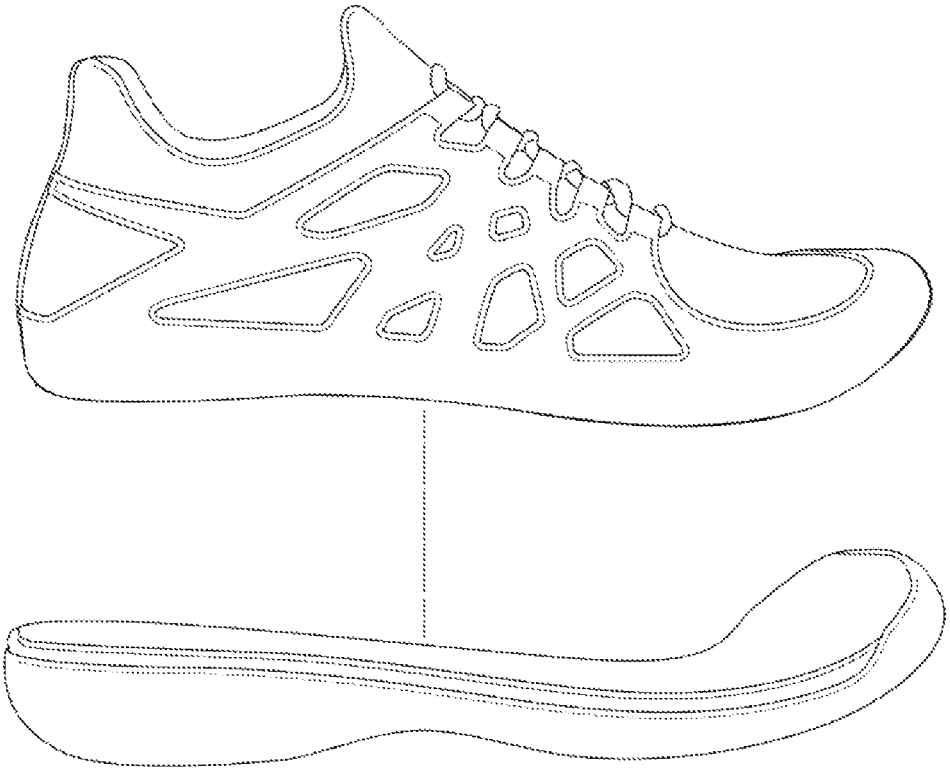
FIG. 7A provides an example of a fitness shoe with a sole in accordance with an embodiment of the invention.

FIG. 7A provides an example of a fitness shoe with a sole in accordance with an embodiment of the invention. As described elsewhere herein, the sole may be separable from the rest of the fitness shoe, or may be integrally connected to the rest of the fitness shoe. The sole may include portions that wrap over a toe and/or heel of the shoe. The sole may include portions that wrap up the side of the shoe. The sole may have a rounded and/or curved shape. The sole may have portions of variable thickness. The sole may be contoured to rise at an arch of the foot.

In some instances, different portions of the shoe may be formed from different materials. Various designs or components may be formed from different material to attain desired structure and/or breathability.

Figure 7B:
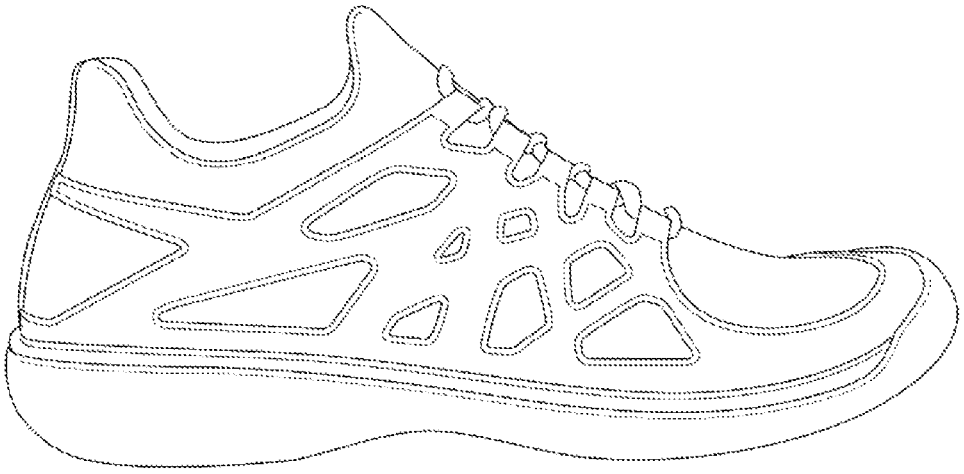
FIG. 7B shows an example of a fitness shoe combined with a sole.

FIG. 7B shows an example of a fitness shoe combined with a sole. The sole may cover at least portions of the toe, heel and/or sides of the shoe. The sole may cover at least 5%, 10%, 15%, 20%, or 25% of the toe, heel, and/or sides of the shoe. The sole may cover varying heights around the circumference of the shoe.

Figure 8A:
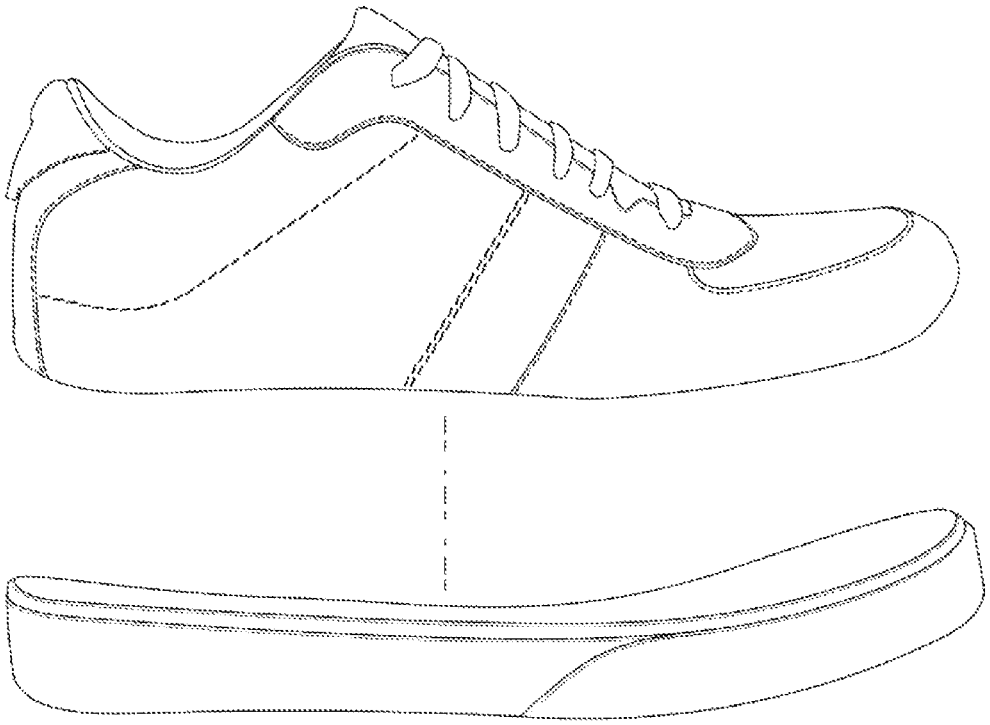
FIG. 8A provides an additional example of a fitness shoe and a sole.

FIG. 8A provides an additional example of a casual shoe and a sole. In some instances, the sole may have a relatively uniform thickness and/or height around the shoe. The sole may cover portions of the toe, heel, and/or sides of the shoe. The sole may have a relative flat bottom. In some instances, the portion of the sole below the arch of the foot may be smooth and contoured to match the rest of the sole. The portion of the sole below the arch of the foot may be configured to contact the surface upon which the individual may stand.

Figure 8B:
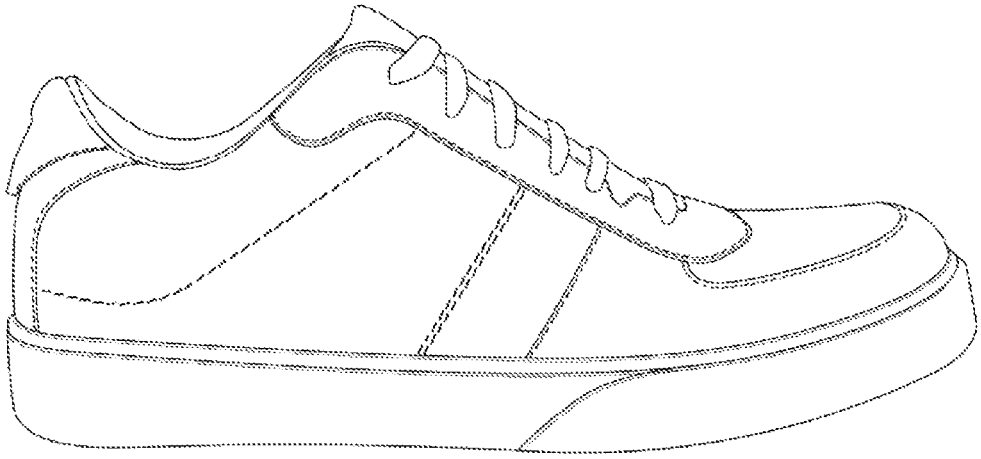
FIG. 8B provides an additional example of a fitness shoe combined with a sole.

FIG. 8B provides an additional example of a casual shoe combined with a sole. The sole may cover at least portions of the toe, heel and/or sides of the shoe. The sole may cover at least 5%, 10%, 15%, or 20%, or 25% of the toe, heel, and/or sides of the shoe. The sole may cover varying or roughly the same heights around the circumference of the shoe.

Figure 6:
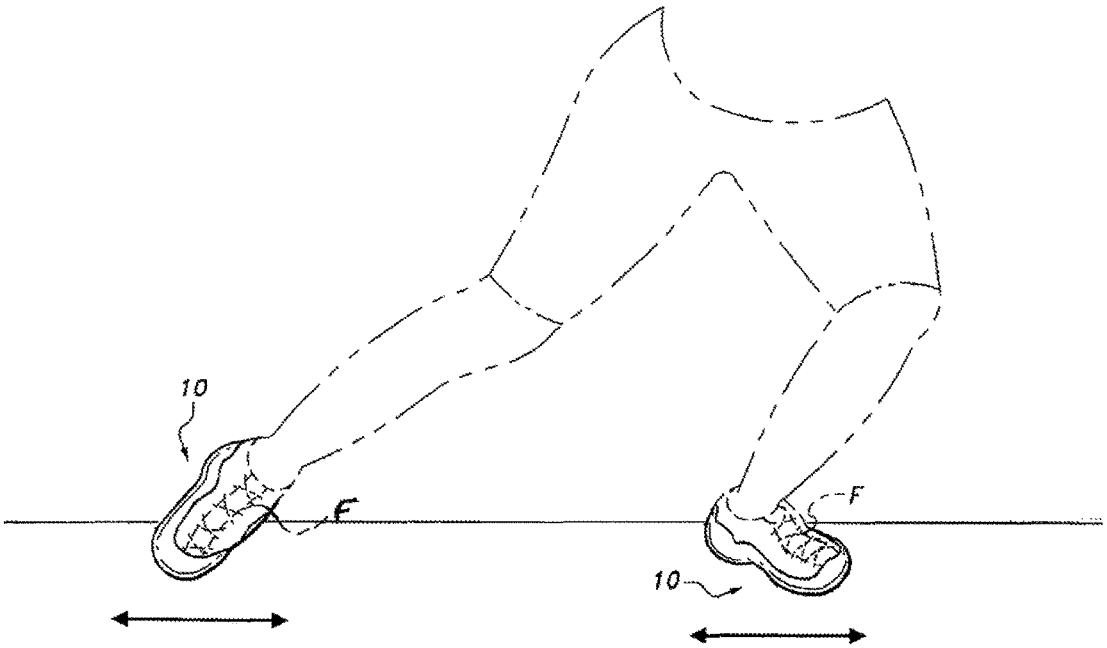
FIG. 6 is an environmental view of sliding-shoe soles that may be used to slide over a contacting surface.

A fitness shoe may be provided in accordance with any embodiment of the invention. The fitness shoe may be a sneaker. The fitness shoe may be useful for exercise, dancing, performances, running, walking, or other activities. In some instances, the fitness shoe is not a dress shoe. In some instances, the fitness shoe does not have a dance shoe body (e.g., sides, heel, toe, and/or top). The fitness shoes may be used in activities where a degree of sliding by the shoe is desired. For example, it may be desirable to slide on a surface, such as a wooden floor (e.g., gym floor), carpet, asphalt, concrete, grass, tile, or other surface. The surface may be a smooth surface or rough surface. Such sliding may be in a lateral direction. FIG. 6 shows an example of shoes that may slide laterally with respect to a surface. For example, such sliding may include sliding in the toe to heel or vice versa direction of the shoe, or from a side to side direction of the shoe. Such sliding may include any diagonal direction. Sliding may include the lateral translation of the shoe position. Sliding may also include rotation of the shoe. The shoe may be used for spinning or twirling. In some instances, the shoe may slide equally easily in any direction. Alternatively, it may be easier for a shoe to slide in a particular direction than a different direction. Sliding may occur while the shoe sole retains contact with the surface. In some instances, the same portion of the shoe sole may contact the surface while the sliding is occurring. In another instances, the portion of the shoe sole that is contacting the surface while sliding is occurring may vary. This may be useful for fitness regimens, exercises, dance, or other performance moves.

The shoe may have one or more characteristics of an athletic shoe. The shoe may include a toe area, heel area, and side areas. The side areas may be between the toe and heel areas. The shoe may also include a top area that may cover at least a portion of the top portion of the wearer's foot. Alternatively, the shoe need not have a top area. The shoe may be formed from any material used to form fitness shoes including but not limited to fabric, polymers, leather, vinyl, rubber, or any combination thereof. In some instances, the shoe may be formed from non-polished leather, or may include non-polished leather or other non-polished materials, such as those described herein. The shoe may be formed from a breathable material (e.g., gas permeable and/or liquid permeable). The shoe may be formed from a single material or from a plurality of materials.

In some embodiments, the fitness shoe may cover at least a portion of the top of the wearer's foot. The fitness shoe may cover a majority or an entirety of a top of the wearer's foot. The fitness shoe may cover an entirety or a portion of the wearer's foot below the ankle. In some instances, the fitness shoe may cover at least 99%, 95%, 90%, or 85% of the wearer's foot beneath the ankle. The fitness shoe may or may not cover portions of the wearer's foot above the ankle. In some instances, laces, Velcro, straps or other features may keep the fitness shoe secured the wearer's foot. In one example shoe laces may be provided over a top portion of the fitness shoe and may be tied to secure the shoe to the wearer's foot. For example, the shoe may have a tongue or flap that may be secured by the laces. The fitness shoe may have padding or elastic support within a bottom portion of the shoe. A bottom portion of the shoe may be formed from a compressible material. The bottom portion of the shoe may have a high degree of elasticity. The fitness shoe may be designed to absorb shock when it makes contact with the ground. A wearer's foot may be exposed to a decreased degree of shock when the user steps or runs with the shoe. In some instances, the degree of shock may be reduced by greater than, less than, or equal to about 10%, 20%, 30%, 40%, 50%, 60%, 70%, 80%, or 90% compared to not wearing any footwear. A shock-absorbing portion may be provided by a shoe sole, or a different portion of the shoe. Alternatively, the shoe need not have a shock absorbing portion.

An outer sole may be provided at or near the bottom of the shoe. As previously described, the outer sole may be permanently affixed to the rest of the shoe, or may be removably detachable from the rest of the shoe. If removably detachable, the sole may remain attached to the shoe for normal wear, and may be removed from the shoe intentionally by an individual. In some instances, an individual may need to use the individual's hands or an implement to remove the sole. In some instances, the rest of the shoe may be fit for use without the sole. The rest of the shoe may have its own sole that may be configured for contacting a ground or other surface. Alternatively, the rest of the shoe may have a bottom that is not configured for surface contact. In some instances, providing a sole on the bottom of the shoe (e.g., permanently or detachably), may prevent the bottom of the rest of the shoe from contacting a ground surface. In some instances, no portion of the bottom of the rest of the shoe, or portions of the bottom of the rest of the shoe may be exposed when the sole is provided on the shoe.

The sole may be attached to the shoe to provide reduced friction. In some instances, the rest of the shoe may have a bottom surface with certain material properties. The sole may have different material properties than the bottom of the shoe. For example, the sole may have reduced friction, increased smoothness, and/or may have different stiffness or elastic properties. The separable sole may have a shape that may cause a portion of the sole to curve or angle over a portion the rest of the shoe, or a portion of a top of the shoe to keep the sole attached to the shoe. In some instances, the sole may flex or stretch when being attached to or removed from the rest of the shoe. When the sole is at rest in a non-flexed or non-stretched state, the sole may be designed to remain on the shoe.

In some instances, the outer sole may be attached to the rest of the shoe using an adhesive. In some instances, one or more portion of the shoe or shoe sole may be partially melted to connect the shoe sole with the rest of the shoe. Other connection mechanisms may be used to attach the outer sole to the rest of the shoe. For example, one or more snap-fit portion, friction-fit, interlocking portion, zipper, button, fastener, connector, or clamp may be used. Such connections may permit permanent or removably detachable connection. In some alternate embodiments, the sole may be integrally formed with the rest of the shoe. For example, the sole may be molded onto the sides of the shoe.

In some instances, once the sole is attached to the rest of the shoe (e.g., permanently or removably), the sole may be configured not to be movable with respect to the rest of the shoe. The sole may remain stationary with respect to the rest of the shoe while the shoe is worn. Alternatively, the sole or portions of the sole may be movable with respect to the rest of the shoe when attached.

The sole may have a bottom surface that contacts the ground or other contact surface when the shoe is worn. The bottom surface may be smooth. Any characteristics herein of the bottom surface may or may not also be applied for other surfaces of the sole, such as front or rear surfaces, or one or more side surfaces. The bottom surface may provide a surface capable of sliding on certain ground surfaces. In some instances, the sole may have a planar surface. The planar surface may be perfectly flat or may be curved. In some instances, the sole does not have grooves, bumps, ridges, channels, protrusions, indentations or other surface features. For example, a smooth sole may be a grooveless or featureless sole. Alternatively one or more groove or surface feature may be provided. For example, a ridge may be provided to reduce the likelihood of hydroplaning without interfering with the soles sliding over a desired surface. The sole may or may not have any features or designs etched into the ground contacting surface. The sole may have an uninterrupted surface. In some alternative embodiments, the sole may have slight features, such as treads or microdots. The sole surface may be perfectly flat or may have a slight curvature to it. The curvature may be angled along the length of the shoe, or along the width of the shoe, or any combination thereof. The curvature may or may not permit an entirety or portion of an arch of the foot to contact the ground. The curvature may be convex, concave, or any combinations thereof.

The sole may have a surface with a low coefficient of friction. Any description herein of the coefficient of friction may refer to a static coefficient of friction, or a dynamic coefficient of friction. Any of the coefficient of friction values described herein may be for a static coefficient of friction value, or for a dynamic coefficient of friction value. For example, when the sole contacts a wooden surface, the coefficient of friction may be less than or equal to about 0.6, 0.55, 0.53, 0.5, 0.47, 0.45, 0.43, 0.4, 0.37, 0.35, 0.33, 0.32, 0.31, 0.3, 0.29, 0.28, 0.27, 0.25, 0.23, 0.2, 0.15, 0.14, 0.13, or 0.1. In some instances, the coefficient of friction may fall between any of the values described above, such as between 0.20 and 0.50, 0.25 and 0.45, or 0.27 and 0.40, or 0.29 and 0.35. The coefficient of friction of the sole may be less than that of a traditional fitness shoe. The wooden surface may be a smooth wooden surface, such as tigerwood hardwood. The coefficient of friction may be between the sole and a dry surface. The coefficient of friction value may be determined using an American Society of Testing and Materials (ASTM) c1028 dry static coefficient of friction test machine, or utilize any other approved ASTM protocols or SATRA protocols.

The coefficient of friction may be less than or equal to that of leather contacting a wooden surface, when the sole of the shoe contacts an equivalent wooden surface. The coefficient of friction and/or smoothness of the material forming the sole may be less than or equal to that of leather or a polymer such as polyurethane. In some instances, the coefficient of friction of the material forming the sole when contacting a surface may be less than or equal to about 120%, 110%, 100%, 90%, 80%, or 70% of the coefficient of friction of leather when contacting the same surface. For example, the coefficient of friction between the shoe-sole and granite may be less than or equal to about 120%, 110%, 100%, 90%, 80%, or 70% of 0.519, 0.5, or 0.4 when dry, or 0.020, 0.010, or 0.008 when wet. The coefficient of friction of the sole may be greater than, less than, or equal to about the friction of coefficient of a gliding disc exercise plate or fitness sliding disc. In some instances, a gliding disc exercise plate or fitness sliding disc may be formed from a hard plastic or fabric. The shoe sole may have a low degree of roughness. A sole of a fitness or athletic shoe with a low coefficient of friction may be counter to typical fitness or athletic shoes where traction is desired.

In some instances, the sole may have a low slip index. In some instances, the shoe may have a slip index of greater than, less than, or equal to about 0.6, 0.55, 0.53, 0.5, 0.47, 0.45, 0.43, 0.4, 0.37, 0.35, 0.33, 0.32, 0.31, 0.3, 0.29, 0.28, 0.27, 0.25, 0.23, 0.2, 0.15, 0.14, 0.13, or 0.1. The slip index values for a shoe on a surface may be provided under equivalent or the same circumstances and/or surfaces as provided for coefficient of friction. The slip index value may be determined using an English XL Machine.

In some instances, the coefficient of friction may be uniform regardless of which portion of the sole is contacting the ground. Alternatively, the coefficient of friction may vary depending on the portion of the sole contacting the ground. The sole may have a uniform smoothness over its surface, or the smoothness may vary. In some instances, it may be desirable to have certain portions of the shoe sole (e.g., toe of the foot, ball of the foot, heel of the foot, rear of the foot, side of the foot, middle portion of the foot) to have a greater or lesser coefficient of friction than the other portions of the shoe sole. In some instances, a portion of the sole having a greater coefficient of friction may act as a brake, stop, or pivot for other portions having a lower coefficient of friction.

The low-friction shoe soles may permit the shoes to function as anti-traction shoes. The shoes may be athletic shoes that are designed to slide over certain surfaces. In some embodiments, the shoes may permit sliding over smooth or soft surfaces, in contrast with typical athletic shoes with soles designed for traction. The low-friction shoe may permit a wearer to perform dance moves or exercises which require shoe sliding moves on surfaces that would not be possible using athletic shoes designed for traction which would stick to the surface. For example, the user may be able to perform movements where the shoe may slide over a surface, such as a gym floor or carpet.

The bottom of the shoe may slide over a surface and/or other portions of the shoe, such as the edges, sides, front, or back of the shoe may also slide. A shoe may be designed to slide over a surface and/or may have a smooth contacting surface, when the shoe is oriented 90 degrees from the surface (e.g., standing upright), or any other angle from the surface including but not limited to greater than, less than, or equal to about 85 degrees, 80 degrees, 75 degrees, 70 degrees, 65 degrees, 60 degrees, 50 degrees, 40 degrees, 30 degrees, 20 degrees, 10 degrees, 5 degrees, or 0 degrees from the surface. In some instances, the angle may even be a negative angle (e.g., −1 degrees, −3 degrees, −5 degrees), if the shoe is tilted at even more extreme angles (e.g., top portion of a toe of the shoe). The shoe may be designed to slide over a surface and/or have a smooth contacting surface when oriented at any angle with respect to vertical, and/or radial angles (e.g., where zero degrees refers to the front of the shoe, the radial angle may be about 0 degrees, 15 degrees, 30 degrees, 45 degrees, 60 degrees, 75 degrees, 90 degrees, 105 degrees, 120 degrees, 135 degrees, 150 degrees, 165 degrees, 180 degrees, 195 degrees, 210 degrees, 225 degrees, 240 degrees, 255 degrees, 270 degrees, 285 degrees, 300 degrees, 315 degrees, 330 degrees, or 345 degrees).

For example, a shoe may be tilted entirely forward, to the back, to the side, or any angle radially therebetween, and the sole may contact the surface. The sole may have a low coefficient of friction that may permit the shoe to slide at any or all of the extreme angles. The sole may be contoured to provide a desired ground-contacting surface that may assist with the sliding. In some instances, the sole surface may be flush with the rest of the shoe. Alternatively, a portion of the sole may protrude from or extend from relative to the rest of the shoe surface to encourage contact between the sole and the contact surface when the shoe is at any desired angle.

Alternatively, only portions of the shoes may be conducive to sliding motions while other portions of the shoe may provide traction. However, the low-friction shoe may be an athletic shoe or have the appearance of an athletic shoe that may be desirable for style or performance reasons. The low-friction athletic shoe may also be comfortable, and may be comfortably used for other activities, such as playing sports, walking or running. In some embodiments, the soles may be formed of a material that may be colored or dyed to match a design of the low-friction athletic shoe.

The sole may be formed from a single integral piece. The sole may be a unitary construct. The sole may be a single molded/shaped piece. In some instances, the sole may be one piece without having additional pieces used to form the sole. The ground contacting surface of the sole may be formed from a single material and/or a single piece. In some embodiments, no breaks or discontinuities may be provided along the ground contacting surface of the sole. In some instances, substantially the entire portion of the sole may contact the ground simultaneously. A bottom surface of the sole substantially coextensive with the rest of the shoe may simultaneously contact the ground. For example, a heel, toe, ball, and middle portion of the sole may simultaneously contact the ground. In some instances, a portion of the sole beneath the arch of the foot may contact the ground. In some instances, a portion of the area under the arch of the foot, the entirety of the area under the arch of the foot, or no portion of the area under the arch of the foot contacts the surface. When at rest a continuous uninterrupted portion of the sole may simultaneously contact the ground. In some embodiments, when at rest, the entire bottom portion of the sole may contact the ground. Alternatively, the sole may be shaped so that only portions of the sole contact the ground simultaneously. The portions of the sole that contact the ground may or may not be continuous (e.g., connected). For example, a heel portion and a ball of the foot portion may contact the ground, while a middle portion does not.

In alternative embodiments, the sole need not be a unitary construct. A plurality of portions may be provided to form the sole. For example, separate heel and toe portions may be provided. The separate portions may or may not be connected to one another. The separate portions may or may not be permanently affixed to one another. The separate portions may have the same material properties or different material properties. In one example, a toe portion may be formed from a material with greater coefficient of friction, and heel portion may be formed from a material with greater compressibility.

The sole may have a desired material property. For example, the sole may be slidable and/or have a surface that results in a low frictional value, as previously described. The sole may have a desired bendability or stiffness. In some instances, it may be desirable for the sole to be flexible and to bend to conform to movements of the foot within the shoe. Alternatively, it may be more desirable for the sole to be stiffer and to keep the sole of the foot at a certain shape. In some instances, the entire sole may be stiff enough to keep the foot from bending. Alternatively, portions of the sole may be stiff and portions may be flexible to permit flexing at certain predefined locations. In another example, the entirety of the sole may be flexible. The sole may or may not have a desired elastic property. In some instance, the sole may have a Young's modulus of greater than, equal to, or less than about 0.01, 0.03, 0.05, 0.07, 0.1, 0.12, 0.15, 0.17, 0.2, 0.23, 0.25, 0.3, 0.35, 0.4, 0.45, 0.5, 0.6 or 0.7. In some embodiments, properties of the shoe sole may be variable based on the morphology of the shoe sole. For example, a shoe sole may flex or bend more easily where the shoe sole is thinner, and may be stiffer where the shoe sole is thicker.

In some instances, the sole may have a desired degree of hardness. For example, the sole may have a hardness greater than, less than or equal to about the hardness of leather. The hardness may fall along a Shore Durometer scale of greater than or equal to about 40 A, 50 A, 60 A, 70 A, 80 A, 90 A, or 100 A. The sole may have a hardness greater than, less than, or equal to the hardness of leather shoe soles with $^{9}/_{10}$ thickness, $^{10}/_{11}$ thickness, or $^{11}/_{12}$ thickness.

The sole may be formed from a selected material that may have one or more material properties. In some instances, the sole may be formed from leather, may include leather or have one or more material properties (e.g., frictional coefficient, flexibility, durability, stiffness, strength, or elasticity) similar to leather. In another example, the sole may be formed from a polymer, such as polyethylene or have a similar material properties. The sole may or may not be formed from an elastomeric material. The sole may or may not contain rubber and/or formica. The sole may or may not have one or more material properties that may be similar to rubber or other elastomeric material. The sole may have a coefficient of friction lower than that of rubber on comparable surfaces. The sole may be formed from a single material or a combination of materials.

The sole may be formed from a solid piece or may have one or more pore or hollow that may retain a fluid, such as a gas or liquid. The sole material may be compressible. In some instances, the sole material may not be very compressible. The sole material may be more compressible, less compressible, or about equally compressible to rubber, leather, polymer, or any other material. In some instances, the sole material may have a Poisson's ratio greater than, less than, or equal to 0.7, 0.65, 0.6, 0.55, 0.5, 0.47, 0.45, 0.43, 0.4, 0.38, or 0.35. In some instances, the sole may be porous. Having a porous sole may permit the sole to absorb shock and/or be compressible. In some instances, an outer portion of the sole that may contact the ground may be a solid piece, which may increase the smoothness of the sole. In some instances, an inner portion of the sole may be porous or solid. For example, the outer ground-contacting surface of the sole may be solid and smooth, while an inner non-exposed portion of the sole may be porous and/or compressible. The compressibility of the sole material may vary within the sole, or may remain the same.

The sole material may have a desired durability. In some instances, the sole may be capable of retaining its material properties for more than 6 months, 9 months, 1 year, 1.5 years, 2 years, 3 years, or 5 years with regular use, which may include regular sliding motions. Examples of regular sliding motions may include greater than, less than, or equal to about 15 minutes, 30 minutes, 1 hour, 2 hours, 3 hours, 5 hours, 7 hours, 10 hours, 15 hours, 20 hours, 30 hours, 40 hours, 50 hours, 60 hours, or 70 hours of wear and/or sliding wear per week. In some instances, the sole may have a life time of greater than, less than, or equal to about 100 miles, 200 miles, 250 miles, 300 miles, 350 miles, 400 miles, 450 miles, or 500 miles of sliding use.

The sole may have a substantially uniform thickness throughout. For example, the sole may have a thickness of greater than, less than, or equal to about 0.1 inches, 0.2 inches, 0.3 inches, 0.4 inches, 0.5 inches, 0.6 inches, 0.7 inches, 0.8 inches, 0.9 inches, 1.0 inches, 1.2 inches, 1.5 inches, 1.7 inches, or 2 inches. In some instances, the sole thickness may vary. The sole thickness may vary between any degrees of thickness including measurements described herein. The sole thickness may vary by greater than, less than, or equal to about 10%, 30%, 50%, 70%, 80%, 100%, 110%, 120%, 130%, 150%, 170%, 200%, 250%, 300% or 400%. In some instances, the thickness may be greater toward a front portion of the shoe, or toward a rear portion of the shoe. In other examples, the thickness may be greater toward an outer side of the shoe or an inner side of the shoe. The thickness may vary in multiple ways along the length and/or width of the shoe. For example, the thickness may increase and/or decrease once or multiple times along the length and/or width of the shoe. In some instances, the thickness of the sole may decrease where greater flexibility is desired. Any change in thickness may be gradual or sudden.

In some instances, a separable sole may be provided. The separable soles may be selected with different material properties and/or morphologies that may be used to fit different purposes. For example, a sole may be provided with a low coefficient of friction. Depending on the use, soles may be selected that may lower coefficients of friction and/or different distributions of smoothness. Similarly, soles with different thicknesses or thickness distributions may be selected for different purposes. Any of the shoe sole characteristics described herein may be selected for different purposes. Separable soles may be swapped for different purposes or uses.

The sole may wrap around a portion of the rest of the shoe. For example, a portion of the sole may wrap around the front, back, and/or sides of the shoes. The portions of the soles that may wrap around other portions of the shoes may rest on top of another material that forms a portion of the shoe. For example, a portion of the sole that encompasses a portion of a heel section of the shoe may rest over or cover a portion of the material forming the heel section of the shoe. The portions of the soles that wrap around another portion of the shoe may have a lesser thickness, a greater thickness, or about the same thickness as the rest of the portions of the sole. For example, a thin layer of sole may overlay a portion of the shoes on the sides, but may be thicker over the bottom surface of the shoe.

In some instances, the soles may wrap over the front, back and/or side of the shoe by any amount. For example, they may wrap up greater than, less than, or equal to about 2 inches, 1.5 inches, 1.2 inches, 1 inch, 0.8 inches, 0.7 inches, 0.6 inches, 0.55 inches, 0.5 inches, 0.45 inches, 0.4 inches, 0.3 inches, 0.2 inches, 0.1 inches, or 0.05 inches or 0.01 inches. They may wrap around the shoe an equivalent amount. Alternatively, they may wrap around at varying amounts. For example, the soles may rise up to encompass a greater portion of the heel and/or toe than the sides, or vice versa. For example, the soles may rise up an inch or more to encompass the heel and toe areas of the shoe, while rising up 0.5 inches to encompass the sides of the shoes.

In one illustration, the soles may rise up to encompass the entire height of the heel of the shoe, or at least 90%, 80%, 70%, 60%, 50%, 40%, 30%, or 20% of the height of the heel of the shoe. In another example, the sole may rise up to encompass the entire height of the toe of the shoe, or at least 90%, 80%, 70%, 60%, 50%, 40%, 30%, or 20% of the height of the toe of the shoe. The sole may rise up and cover a top portion of the toe area of the shoe. The sole may rise up to encompass the entire height of a side area of the shoe, or at least 90%, 80%, 70%, 60%, 50%, 40%, 30%, or 20% of the height of the area of the shoe. The sole may rise up the same amounts for the right and left sides of the shoe, or may rise up different amounts.

The sole may or may not leave a top portion of the shoe exposed. For example, the sole may or may not cover a portion of a laces portion of the shoe. In some instances, the sole may or may not cover a top half of the shoe, top two thirds of the shoe, or top three quarters of the shoe. In some instances, not all portions around the circumference of the shoe may have the sole wrapping up. For example, the shoe may wrap up for a portion of the side area circumferentially without wrapping up the entire side area. Alternatively, the entire circumference of the shoe may have the sole wrapping up. For example, the entire circumference of the shoe sole may have a portion rising up to encompass a portion of the shoe.

In some embodiments, a sole may have any shape. The sole may be coextensive with the rest of the shoe. In some instances, the sole may have rounded corners. For example, a bottom portion of the sole may contact the ground. A side portion of the sole may not contact the ground. In some instances, the side portion of the sole does not contact the ground while the bottom portion of the sole is contacting the ground, but may contact the ground at other times. The interface where the bottom portion of the sole contacts the side portion may be rounded. In some instances, the sole may be rounded without any sharp edges or corners. Alternatively, edges or corners may be provided. The edges or corners may be sharp, beveled, and/or rounded. For example, the corners may be tapered at any angle, such as 30 degrees, 45 degrees, or 60 degrees. In some instances, the rounded portions of the soles may be smooth. A low coefficient of friction, such as values described elsewhere herein, may be provided for the bottom of the shoes and/or the sides of the shoes wrapping up (e.g., front portion, heel portion, side portions). The low coefficient of friction may be provided for tapered or rounded corners of the soles. This may permit the shoe to be used for sliding at many angles. For example, the shoe may be able to slide across a surface when the shoe is angled sideways or forwards and backwards. For example, the shoe may be able to slide when a toe portion of the sole is contacting the ground, a heel portion is contacting the ground, a side portion is contacting the ground, an edge is contacting the ground, or any other portion of the sole is contacting the ground.

Figure 9:
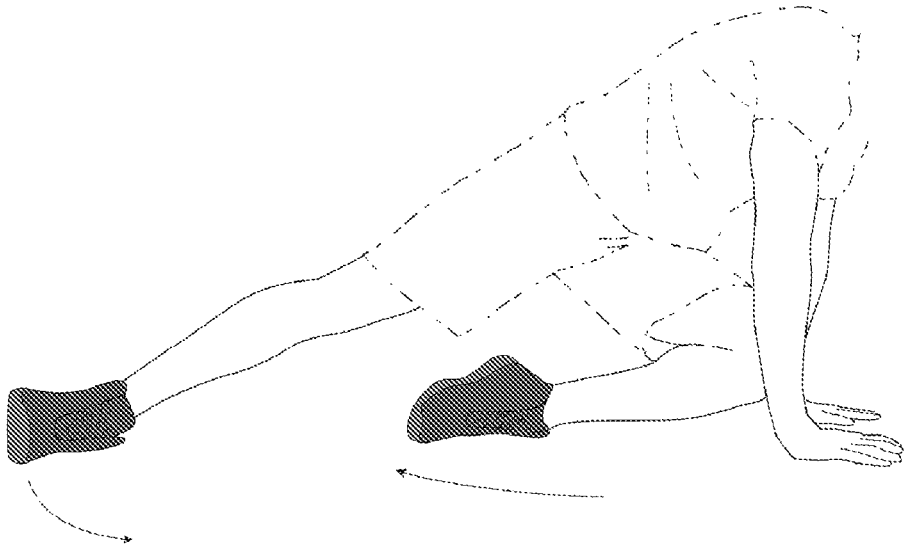
FIG. 9 provides an example of a fitness shoe with sliding shoe sole in use, in accordance with an embodiment of the invention.

FIG. 9 provides an example of a fitness shoe with sliding shoe sole in use, in accordance with an embodiment of the invention. The sliding sole of the shoe may come up over the side and/or toe/heel portions of the shoe in order to contact a ground surface when the shoe is provided at many different angles. For example, the shoe may be angled so that the side of the shoe is contacting the ground. The sliding sole may be provided up over at least a portion of the side of the shoe, so that the sole contacts the ground, when the wearer performs a sideways move. The shoes may slide relative to one another, and the feet may be capable of moving in different directions.

Figure 10:
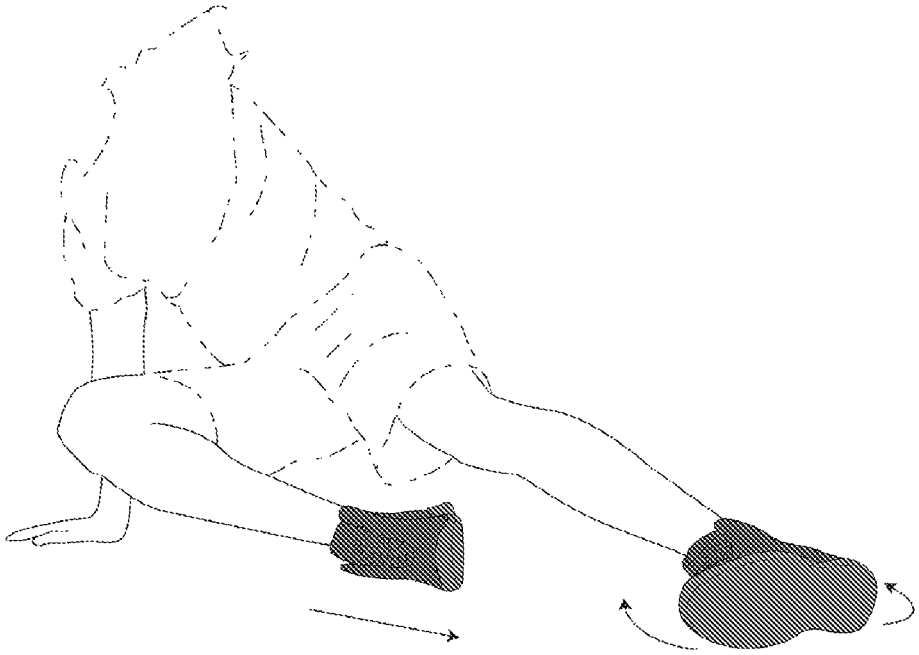
FIG. 10 provides an additional angle from which a fitness shoe with a sliding shoe may be used.

FIG. 10 provides an additional angle from which a fitness shoe with a sliding shoe may be used. An outer side edge of a shoe and/or inner side edge of the shoe may have a sliding sole, such as those described elsewhere herein, contacting a ground surface. The shoe may permit sliding movements along the sides of the shoe along a straight and/or curved path. One or more shoe may be capable of sliding back and forth. Both shoes may slide simultaneously. Alternatively, one shoe may remain at a fixed location while the other shoe slides.

Figure 11:
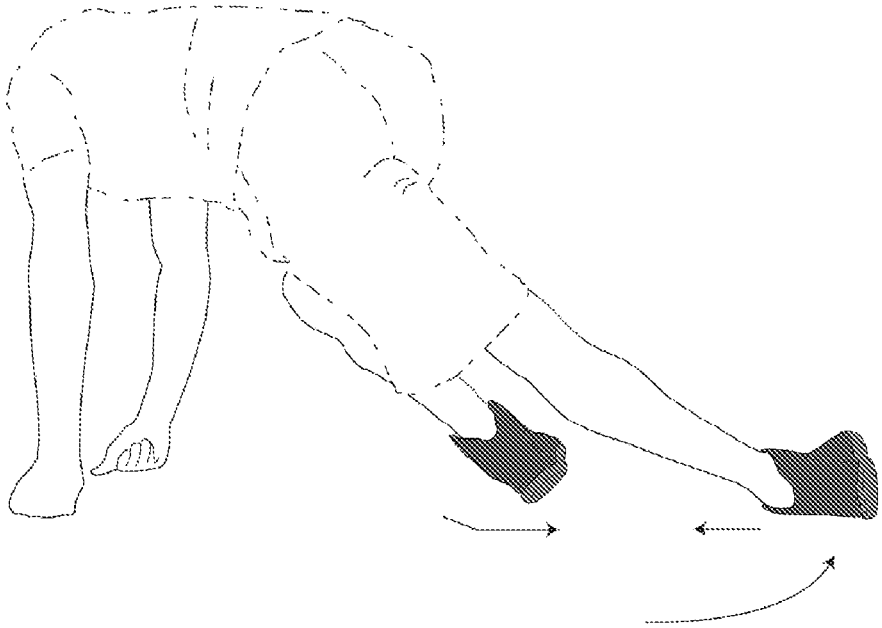
FIG. 11 provides more angles or movements that may be performed with a fitness shoe with sliding sole.

FIG. 11 provides more angles or movements that may be performed with a fitness shoe with sliding sole. In some instances, the soles may or may not protrude from a surface of the shoe. For example, a sole that wraps around a portion of the side of the shoe may extend out relative to the rest of the side surface of the shoe. This may encourage the sole of the shoe to contact the surface when the shoe is provided at steep angles. For example, a shoe may be nearly flat on its side on a surface, and the primary contact of the shoe with the surface may be via the sole.

In some alternate embodiments, even if the sole does not reach up over a toe, heel and/or side portion of the shoe, the sole may protrude relative to the side of the shoe, thus permitting the sole to be the contact between the ground and surface, even if the shoe is at any angle relative to the ground, such as near-horizontal angles. The sole may protrude in a gradual contoured manner to encourage contact with the ground surface while being visually subtle.

In other embodiments, the sole need not protrude from the front, side, and/or rear of the shoe. The sole may be flush with the rest of the surface of the shoe or may be indented into the surface of the shoe.

Figure 12:
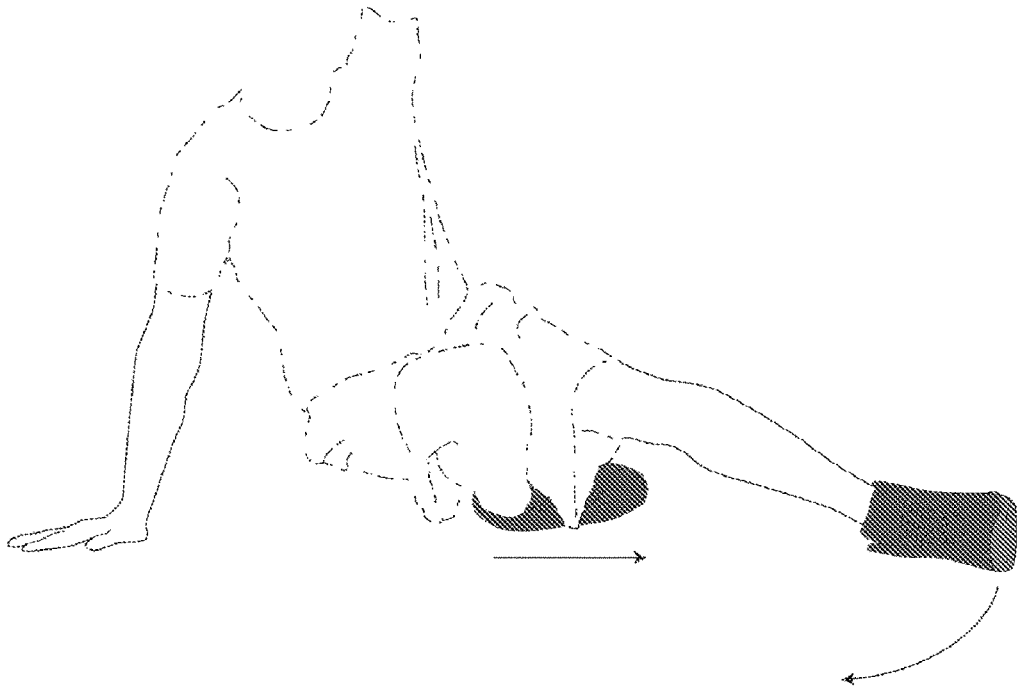
FIG. 12 shows another example of a move that may be executed using a fitness shoe with sliding sole.

FIG. 12 shows another example of a move that may be executed using a fitness shoe with sliding sole. As previously described, the two shoes may slide relative to one another. In some instances, the shoes may be moving simultaneously, toward each other, away from one another, or at the same distances relative to one another. In some instances, a hand, two hands, or other portions of the body may be used as a point of contact with the surface while the shoes are sliding. Alternatively, no hands or other body portions need to be provided. The coefficient of friction may be sufficiently low that both shoes may slide simultaneously without requiring additional pivot or fixed points. In some instances, both shoes may slide along different paths or in different ways. For example, a first shoe may slide along a straight path while the other follows a curved path.

Figure 13:
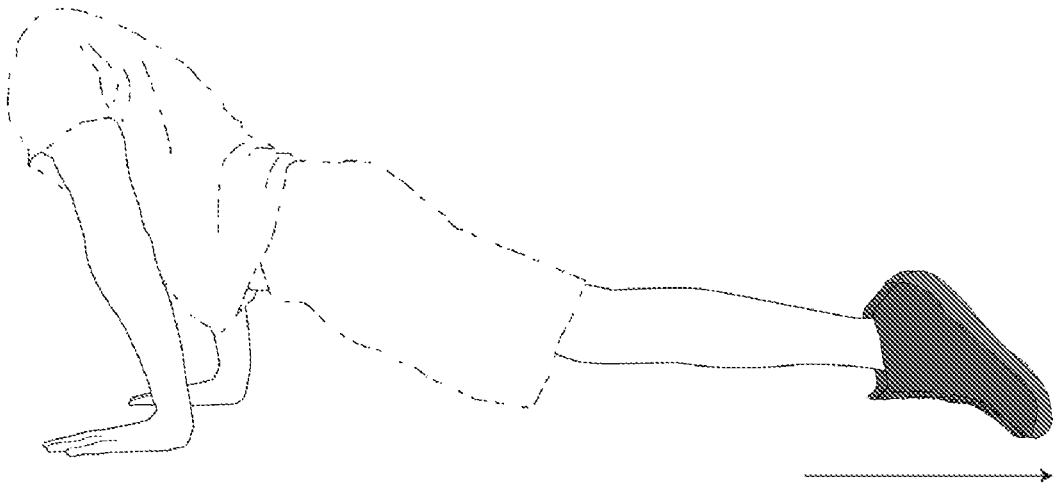
FIG. 13 shows a sliding motion that may be possible using a sliding sole fitness shoe.

FIG. 13 shows a sliding motion that may be possible using a sliding sole fitness shoe. A toe portion of the shoe may have a sole that may come up and wrap around at least a portion of the toe. This may permit sliding of the shoes when the toes are in contact with the ground surface.

Figure 14:
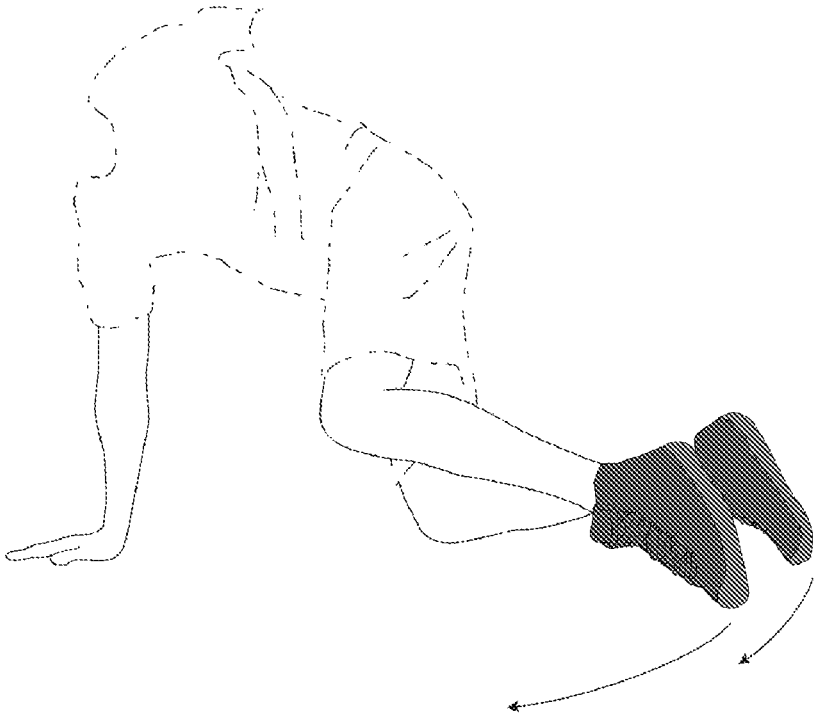
FIG. 14 shows an example of a swinging move that may be performed with a sliding sole shoe.

FIG. 14 shows an example of a swinging move that may be performed with a sliding sole shoe. A portion of the toe and/or side of the shoe that contacts the ground surface may be formed from a material with a low coefficient of friction. In some instances, the portion of the toe and/or side of the shoe that contacts the ground surface may be the sole, which may wrap around a portion of the toe and/or side, or may protrude from the toe and/or side.

Figure 15:
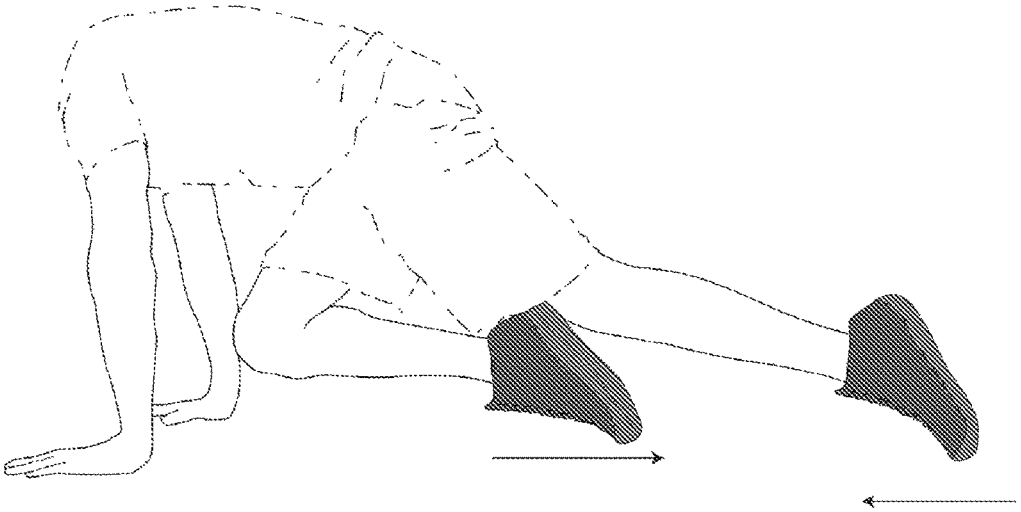
FIG. 15 illustrates an example of opposing motions that may be possible using a sliding sole shoe.

FIG. 15 illustrates an example of opposing motions that may be possible using a sliding sole shoe. As previously described, the sliding motions may be permitted as a sliding sole may be the point of contact between the shoe and the ground surface. The sole may be configured to be the point of contact with the ground surface when the shoe is angled forward so that the toe is contacting the ground, when the shoe is angled backward so that the heel is contacting the ground, when the shoe is angled sideways, so that the side is contacting the ground, and/or any angle in between.

Figure 16:
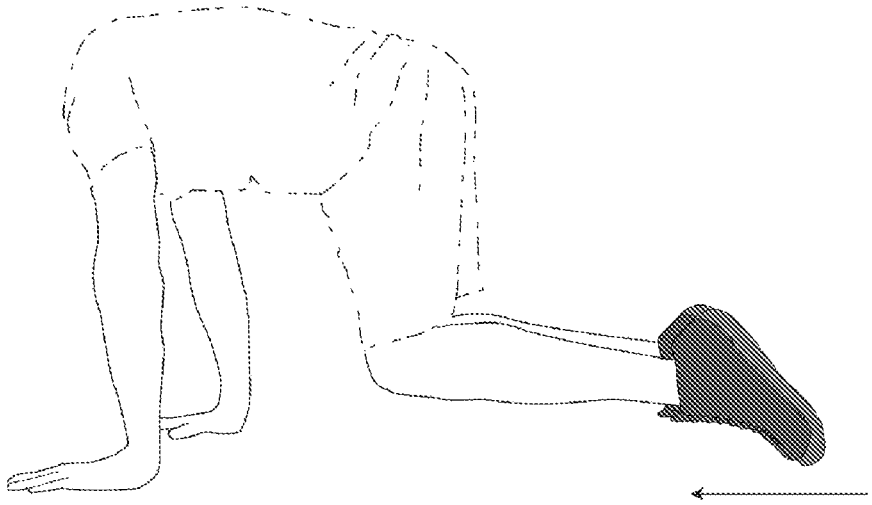
FIG. 16 shows an additional example of a sliding motion that may be enabled by a fitness shoe with a sliding sole.

FIG. 16 shows an additional example of a sliding motion that may be enabled by a fitness shoe with a sliding sole. The sole may wrap around a portion of the toe of the shoe. In some instances, the sole may wrap all the way up around the toe of the shoe. The sole may or may not cover a top portion of the toe of the shoe. Covering a top portion of the shoe toe may be useful when sliding along a ground surface at an angle where the top portions of the toes come into contact with the ground.

Figure 17:
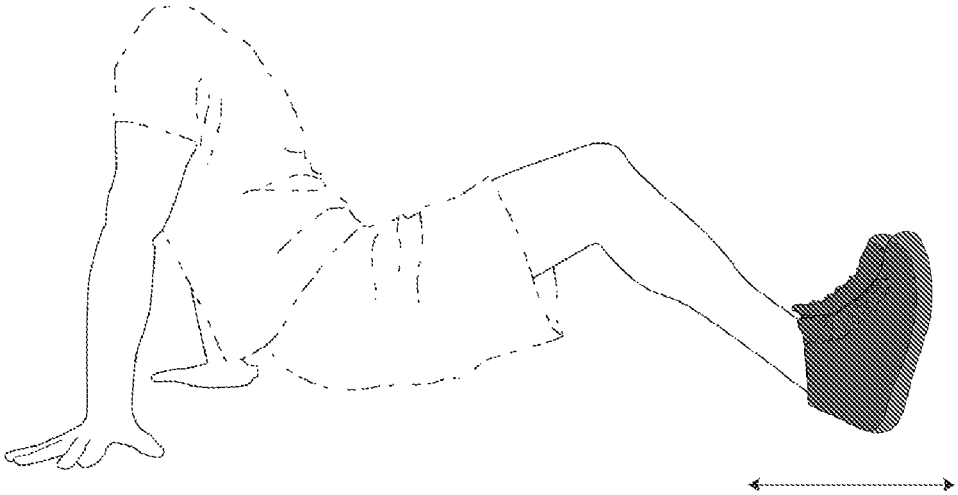
FIG. 17 shows an example of a motion that may be performed using a sliding sole shoe, where the heel portion of the sole contacts the surface.

FIG. 17 shows an example of a motion that may be performed using a sliding sole shoe, where the heel portion of the sole contacts the surface. The sole may wrap up around at least a portion of the heel. The sole may wrap up around an entirety of the heel. Alternatively, the sole may extend or protrude out away from the heel so that the contact surface between the heel and the ground surface is the heel, even when the shoe is angled backwards.

Figure 18:
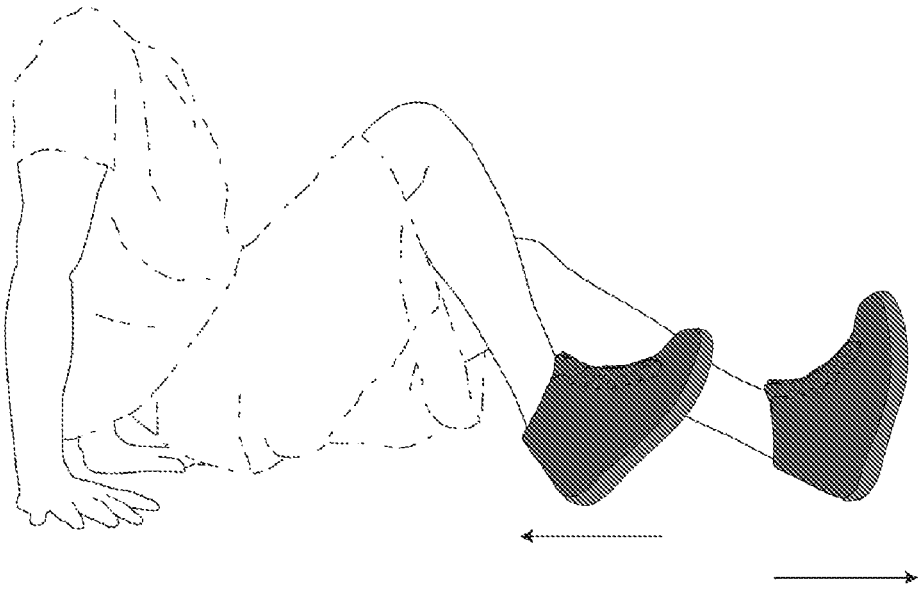
FIG. 18 provides an additional example of a heel sliding motion that may be performed using sliding soled shoes.

FIG. 18 provides an additional example of a heel sliding motion that may be performed using sliding soled shoes. Opposing sliding motions may be provided by the feet. The shoes may move simultaneously.

Various portions of the shoe may bear the brunt of the sliding motion. For example, the heels, toes, and/or sides of the shoes may be capable of bearing the brunt of the sliding motion. The shoes may be capable of bearing an individual's weight and sliding from multiple angles of the shoe, such as various shoe vertical tilt angles and/or radial tilt angles.

It is to be understood that the present invention is not limited to the embodiments described above, but encompasses any and all embodiments within the scope of the following claims. It should be understood from the foregoing that, while particular implementations have been illustrated and described, various modifications can be made thereto and are contemplated herein. It is also not intended that the invention be limited by the specific examples provided within the specification. While the invention has been described with reference to the aforementioned specification, the descriptions and illustrations of the preferable embodiments herein are not meant to be construed in a limiting sense. Furthermore, it shall be understood that all aspects of the invention are not limited to the specific depictions, configurations or relative proportions set forth herein which depend upon a variety of conditions and variables. Various modifications in form and detail of the embodiments of the invention will be apparent to a person skilled in the art. It is therefore contemplated that the invention shall also cover any such modifications, variations and equivalents.

What is claimed is:

1. A sneaker for dancing or exercising comprising:

an upper body having a heel region, a toe region, an opening for a foot, and features for securing the sneaker to a wearer's foot; and a sliding bottom sole having a substantially smooth planar contoured coextensive surface spanning an entire bottom region of the sneaker that extends to and wraps upwardly and vertically over or around at least a portion of the toe region, a pair of side regions and the heel region of the upper body of the sneaker, further wherein the sliding bottom sole is formed of a single piece and permanently molded onto and covering at least 5-25% of the toe, heel and side portions of the upper body, and formed with a uniform and uninterrupted grooveless or featureless surface to facilitate sliding in any direction across a range of selected surfaces comprising: a wooden floor, carpet, asphalt, concrete, grass or tile, wherein substantially the entire portion of the sliding bottom sole simultaneously contacts the selected surfaces;

and wherein the integrally formed wrap around sliding bottom sole is entirely fabricated from a substantially non-stretchable rigid material having a thickness of at least 0.5 inches throughout a length of the sole, and a coefficient of friction of 0.5 or less when contacting selected surfaces to more readily perform dance moves or exercises which require sliding or spinning movement in any direction that would not be otherwise possible on the surface using athletic shoes predominantly designed for traction.

2. The sneaker of claim 1, wherein the sliding bottom sole, the heel region, the toe region and the side regions are of unitary construction.

3. The sneaker of claim 1, wherein the sliding bottom sole meets the heel region, the toe region, and the side regions in a curved manner.

4. The sneaker of claim 1, wherein the heel region, the toe region, and the side regions extend from the sliding bottom sole by at least 0.5 inches.

5. The sneaker of claim 1, further comprising laces configured to secure the sneaker to a wearer's foot.

6. The sneaker of claim 1 wherein the sliding bottom sole is permanently affixed to a rest of the sneaker.

7. The sneaker of claim 1 wherein at least portions of the sliding bottom sole rise at least 0.5 inches to cover at least portions of the toe region, the heel region, and the side regions.

8. The sneaker of claim 1 wherein the sliding bottom sole rises and encompasses at least portions of the toe region, the heel region, and the side regions over an entirety of a circumference of the sliding bottom sole.

* * * * *